United States Patent [19]

Finsterwalder

[11] 4,195,951

[45] Apr. 1, 1980

[54] CONTAINER FOR THE OFFSHORE STORAGE OF LIQUIDS

[75] Inventor: Ulrich Finsterwalder, Munich, Fed. Rep. of Germany

[73] Assignee: Dyckerhoff & Widmann Aktiengesellschaft, Munich, Fed. Rep. of Germany

[21] Appl. No.: 888,618

[22] Filed: Mar. 21, 1978

[30] Foreign Application Priority Data

Mar. 29, 1977 [DE] Fed. Rep. of Germany ....., 2713756

[51] Int. Cl.[2] ..... E02B 17/00; E02D 27/38

[52] U.S. Cl. ..... 405/210; 114/256; 405/204

[58] Field of Search ..... 61/86, 87, 101; 114/256, 257, 264; 220/18; 405/203, 204, 210

[56] References Cited

U.S. PATENT DOCUMENTS

| | | | |
|---|---|---|---|
| 3,422,628 | 1/1969 | McDonald | 61/101 |
| 3,717,001 | 2/1973 | Tam | 61/101 |
| 3,798,919 | 3/1974 | Hershner | 61/101 X |
| 3,824,795 | 7/1974 | Mo | 61/101 |
| 3,889,477 | 6/1975 | Tam | 61/101 |

*Primary Examiner*—David H. Corbin

*Attorney, Agent, or Firm*—Toren, McGeady and Stanger

[57] ABSTRACT

Containers for storing crude oil or other liquids at offshore locations are formed preferably of reinforced concrete, though prestressed concrete can be used. The containers can be floated into position and sunk onto the ocean floor. Each container is bottle-shaped and consists of a lower storage section and an upper or neck section. The lower section is located below water and the neck section extends upwardly to a point above the water level. The maximum diameter of the lower section is considerably greater than the maximum diameter of the upper section. A platform or platform section can be provided on the upper end of the upper section. A number of containers can be grouped together and interconnected at their upper ends by a platform.

12 Claims, 5 Drawing Figures

CONTAINER FOR THE OFFSHORE STORAGE OF LIQUIDS

SUMMARY OF THE INVENTION

The present invention is directed to a container, preferably formed of reinforced concrete, for the storage of liquids, such as crude oil, with the container positioned on the ocean floor.

In the recovery of crude oil from reserves located below water, so-called offshore areas, collection points are established made up of containers for the intermediate storage of the crude oil. The oil removed from underwater wells is stored in the containers before being loaded into tankers. Such collection points, also known as "single point mooring", consist of a storage container which projects above the water level and of a platform supporting the necessary equipment, or of a container located wholly below water with a platform located above the container supported by an intermediate structure.

An example of such an arrangement is the so-called Ekofisk area in the North Sea off the Norwegian coast where such a collection point consists of a nine-cell silo of prestressed concrete. This unit is supported on the ocean floor in water approximately 70 meters deep and it projects about 12 meters above the water level. Construction of this container consisting of the nine-cell silo was commenced at the coast and then towed out to sea to the desired location and sunk continuously as the silo walls were constructed.

Although an annular perforated wave breaking wall is provided around this container unit to reduce the energy of oncoming waves, the soil pressures resulting from the wave forces and transmitted from the base plate of the container unit to the ocean floor are significant. This arrangement is particularly disadvantageous since, due to the wave pressure and undertow at one side of the container unit, very high pressures are created at the edges while the pressure on the opposite side is released. The sand in the ocean floor is saturated with pore water. Due to the high pressures at the edges of the container, this pore water is pressed out of the sand. Since the pore water does not re-enter the pores during a subsequent pressure release, variable settlement occurs in the ocean floor. Moreover, since the direction of the wave action changes, after a period of time, there is the danger that the container will only be supported at the middle portion of its base while around its outside edges the container loads are no longer satisfactorily transmitted to the ocean floor. As a result, the container may rupture and possibly develop leaks.

The forces acting on the container can be reduced when the container, as is possible in deep water, is lowered onto the ocean floor and a platform is erected on support columns made of steel or reinforced concrete extending upwardly from the container. Since such containers are arranged in deep water, the pressures acting under the edges of the container base are significant and similar difficulties may develop. In addition, there are the problems which often result from the unfavorable floating behavior of such containers. Due to the depth of their draft, such containers cannot be constructed at the shore and then towed out to sea where they are finished and sunk into position.

The primary object of the present invention is to provide a container which can be produced economically, is floatable, can be securely founded on the ocean floor without difficulty and can incorporate a platform.

In accordance with the present invention, the container is generally bottle-shaped and consists of a lower container section and an upper or neck section. The lower section is constructed as a body of rotation with a curved generatrix. The neck portion narrows from the upper end of the lower section and, at its upper end, projects above the water level. Advantageously, the bottom of the container is thicker than its other wall portions. The ratio of the diameters of the lower section and the upper or neck section and the thickness of the bottom are advantageously dimensioned so that the container is floatable while maintaining an essentially vertical axis. The transition of the surface between the lower and upper sections has a constant curvature.

Preferably, the lower section is ball-shaped and a tangent through the junction between the lower and upper sections, and the vertical axis of the container form an angle of approximately 45°.

A platform can be mounted on the upper end of the upper section above the water level.

The advantage of the container embodying the present invention is essentially based on its shape. Due to the construction of the lower section as a body of rotation with a curved generatrix, the container wall in this region has the effect of a shell and, as a result, can be kept very thin. Accordingly, the amount of materials required for the container can be kept relatively small. Moreover, the weight of the container in relation to its storage space is low.

Another advantage of this construction is its floatability and its floating stability at a low draft which allows construction along the shore line even in shallow water. In a container having a diameter of 60 meters and a total height of 130 meters, the draft is only about 10 meters. It is possible by appropriate ballasting, for example, by varying the wall thickness in the bottom of the lower section of the container, to locate the center of gravity below the metacenter so that the container has floating stability in spite of its great height. The favorable floating behavior is not lost even if the container is partially or completely flooded when the container is sunk onto the ocean floor. The increased wall thickness of the container bottom also contributes to a favorable distribution of the loads to the ocean floor, the loads are always well centered due to the curved bottom surface.

Concerning the surface of the container supported on the ocean floor, it is considered advantageous if the lower section of the container is formed as an ellipsoid of rotation which is flattened in the region resting on the ocean floor. A container shaped in this manner has good floating characteristics and can be securely supported to a sandy ocean floor. The container is not significantly deflected from its position on the ocean floor by the wave action. At any rate, the forces generated by the wave action are insignificant, since the waves act only on the slender upper or neck section of the container. The foundation conditions are not effected by the wave action. Further, a platform can be mounted on the upper end of the container above the water level.

A particular advantage of the container embodying the present invention is that several such containers, preferably three, can be grouped together each inclined toward the others and interconnected by a common platform. Each container can be constructed with a circular sector-shaped platform section with the sections joined together to form the common platform.

It is advantageous if the lower section is constructed as three-quarters of a ball or sphere with the upper or neck section extending upwardly from the upper end of the ball-shaped section. Concerning the floating properties of the container, it is particularly advantageous if the metacenter of the floating body is located in the center of the ball-shaped section, that is, the metacenter is equidistantly spaced from all points on the outer wall of the ball-shaped section.

The spherical surface on the bottom of the container insures an adequate centering of the foundation surface in all cases. Moreover, the spherical bottom surface provides the possibility that the container can be pivoted on the ocean floor as in a joint for locating the container in an inclined position. Accordingly, in a group of three containers with each of the containers arranged at the corner of a triangle and with their neck sections inclined inwardly toward one another, they can be connected together by means of a platform. Since the containers are only connected to one another at the upper ends of their upper or neck sections, stresses resulting from squeezing are not created in the foundation of the container. This is so particularly since the loads act vertically in the region of the spherical surfaces, even if the containers are in an inclined position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
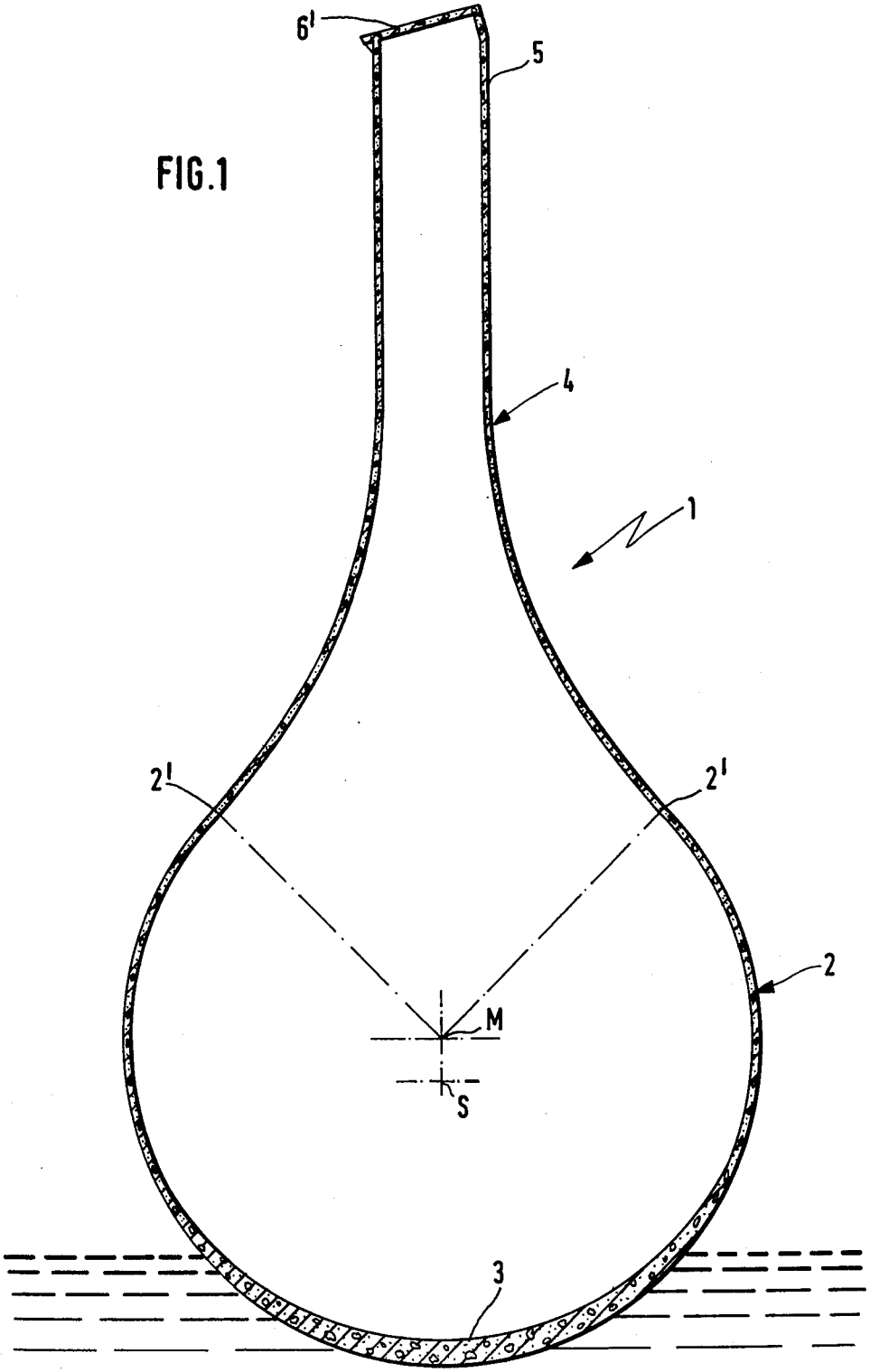
FIG. 1 is a vertical sectional view through a container embodying the present invention.

In FIG. 1 a vertically extending container 1 is shown having a lower storage section 2 in the form of three-quarters of a ball or sphere and an upper or neck section 4 extending from the top of the lower section with the diameter of the upper section 4 decreasing in the upward direction from the top of the ball-shaped lower section. The upper section 4 is connected to the lower section 2 at the inflection point 2' on the outer surface of the container wall. The container 1 can be constructed of reinforced concrete, since the same pressure prevails inside and outside when the container is in use, that is, when it is filled with liquid. Under certain conditions, however, the container wall can be formed of prestressed concrete. Even though it is preferred to provide a transition section of constant curvature from the lower section 2 to the upper section 4 to provide the supporting effect of a shell, in another embodiment, not shown, it is possible to connect the upper end of the ball-shaped lower section to a truncated cone which, in turn, is connected to a cylindrical tubular member forming the upper end of the upper section 4. The outer surface of the lower section is convex and has a continuous curved configuration from the intersection of the axis of the container with the bottom 3 to the plane containing the inflection points 2'.

The ball-shaped lower section 2 is ballasted by increasing the wall thickness of the bottom 3. In this manner, the center of gravity S of the container is located a small distance below the metacenter M which coincides with the center of the ball-shaped lower section. In FIG. 1, the container is shown in the floating condition. As a result of its shape, the container 1 has a very low draft and excellent floating properties. Accordingly, the container can be constructed along the shore and then towed out to sea to its location of use. When the container is positioned at its location of use, it can be sunk onto the ocean floor.

Figure 2:
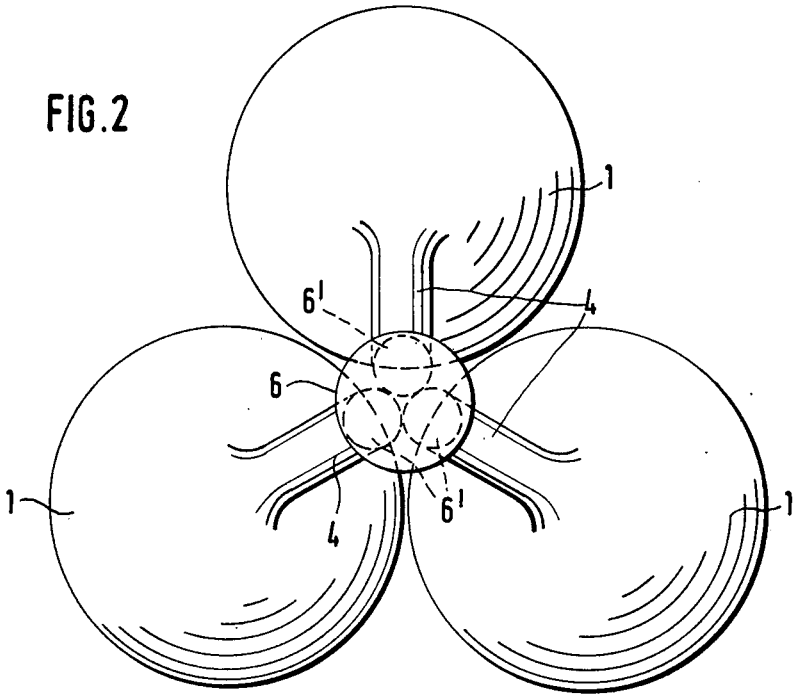
FIG. 2 is a plan view of a group of three containers each in an inclined position.
Figure 3:
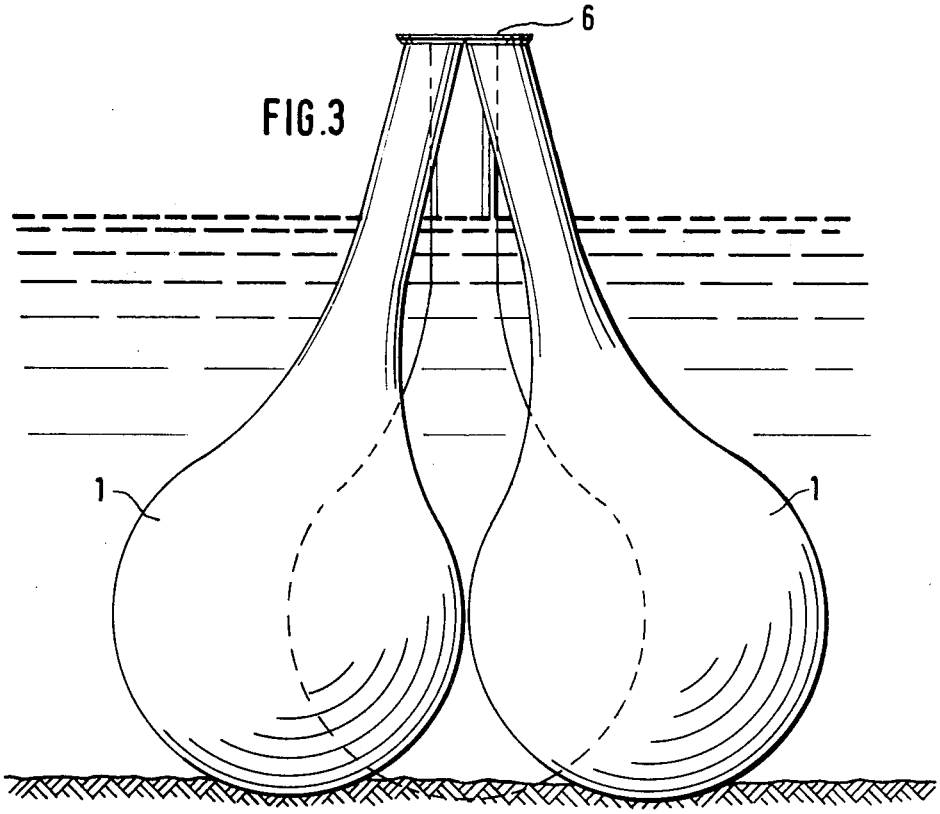
FIG. 3 is a vertical side view of the container arrangement shown in FIG. 2.

The container illustrated in FIG. 1 is intended to be combined with a platform in the manner shown in FIGS. 2 and 3. A platform element 6' is located at the upper end 6 of the upper section 4. In horizontal projection, the platform element 6' has the shape of a circular sector. The platform element is shown inclined to the horizontal, that is, it is positioned to provide a horizontal platform when the container 1 is disposed into an inclined position relative to the vertical.

FIG. 2 illustrates a top view of a group of three containers 1. Each container 1 is constructed in the same manner and is arranged at one corner of a triangle. The upper sections 4 of the containers are in abutting relationship at the center of the triangle. FIG. 2 also shows a circular section-shaped platform element 6' on each of the containers combined to form a circular platform 6. In FIG. 3 a side view is provided of the group of containers 1. When the containers are in place, the platform 6 can be enlarged without any difficulty. To enlarge the platform, walkways or gangways, bridges and the like can be attached to it, such as by cantilevering, so that the tankers can be loaded directly from the platform.

Figure 4:
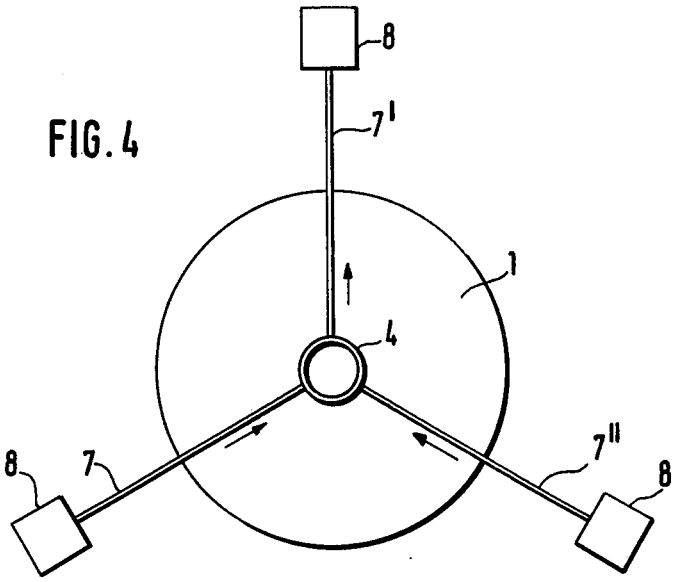
FIG. 4 is a schematic top view for anchoring a container preparatory to placing it in an inclined position.

After a container has been sunk onto the ocean floor, it can be brought into the inclined position required for the arrangement in FIGS. 2 and 3 with the apparatus shown in FIG. 4. In FIG. 4, a container 1 is sunk in the vertical position and connected to traction members 7, 7' and 7'' at its upper section 4. These traction members are secured to the ocean floor by means of anchors 8. The vertically arranged container 1 can be moved into the inclined position by shortening one of the traction members, for example traction member 7', and by lengthening the other two traction members 7 and 7''.

Further, it is possible to dispose the containers in the inclined positions while they are floating and to interconnect the upper ends 5 of their upper sections 4. In such an arrangement, the containers are disposed in point-contact and can be towed and sunk in this condition.

Figure 5:
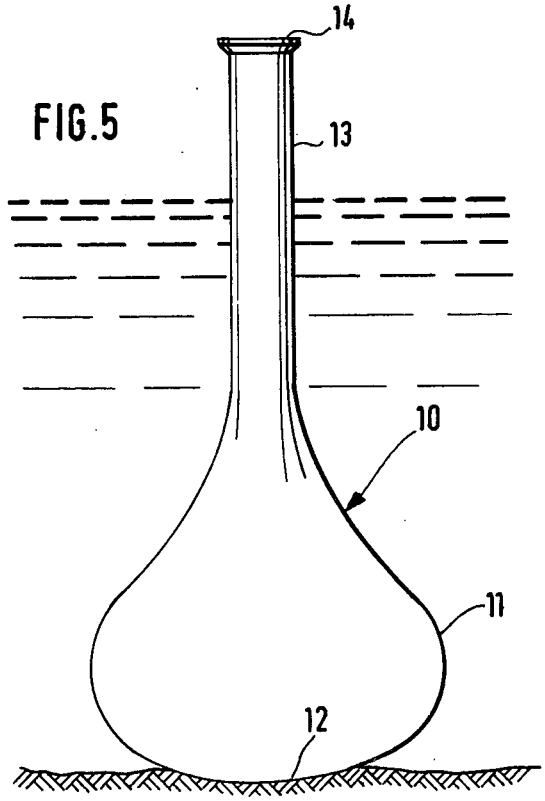
FIG. 5 is a vertical sectional view through another embodying the present invention having a lower section formed as an ellipsoid of rotation.

In FIG. 5 another container 10 is disclosed having a lower storage section 11 constructed as an ellipsoid of rotation. This container is intended to be used in the upright or vertical position. The lower section 11 of the container has a flattened bottom 12 which rests on the ocean floor. Further, a platform 14 is positioned at the upper end of the upper or neck section 13 of the container.

The containers described above and embodying the present invention, are primarily intended for use in storing liquids, such as crude oil. By providing appropriate insulation, however, the containers can be used for the storage of liquified gas. In such a use, the missing weight could be replaced by appropriate ballasting of the container or by anchoring it. Accordingly, several individual containers can be used advantageously in quiet water near the shore line while observing the provisions of environmental protection.

What is claimed is:

1. A container formed of reinforced concrete can be floated into position at an offshore location and sunk onto the ocean floor, the container can be used for the storage of liquid, such as crude oil, wherein the improvement comprises that the container has an upwardly extending longitudinal axis, a bottom, and a lateral portion extending upwardly from the bottom, said container includes a lower hollow container section forming the bottom and a first part of the lateral portion extending upwardly from the bottom and an upper hollow container section having a smaller diameter than said lower section and forming a second part of and extending upwardly from the upper end of the first part of the lateral portion forming the lower section, said lower section including the bottom and the first part of the lateral portion formed as a body of rotation having a curved generatrix with a variable diameter about the longitudinal axis of the container and forming a curved bottom and curved first part of the lateral portion with the outer surface of said lower section from the location of the longitudinal axis passing through said bottom to the upper end of the first part of said lateral portion having a continuous convex configuration in the upwardly extending direction of the container, said upper section connected to and extending upwardly from the upper end of said lower section and the diameter of said upper section decreasing in the upward direction from its connection to said lower section, the maximum diameter of said upper section being less than the maximum diameter of said lower section, and said curved bottom of said lower section permitting support for the container when the longitudinal axis of the container is disposed at an angle to the vertical.

2. A container, as set forth in claim 1, wherein the bottom of said lower section has an increased thickness relative to the upwardly extending first part of the lateral portion.

3. A container, as set forth in claim 1, wherein the ratio of the diameters of said lower and upper sections and the thickness of the bottom of said lower section are dimensioned so that said container can be floated while maintained in an essentially vertical position.

4. A container, as set forth in claim 1, wherein said lower and upper sections form an axially extending transition section concentric with the longitudinal axis of said container and said transition section extending between the outer surface of said lower and upper sections and having a constant curvature in vertical section.

5. A container, as set forth in claim 1, wherein said lower section is in the form of an ellipsoid of rotation flattened at the bottom which forms the foundation for the container.

6. A container, as set forth in claim 1, wherein said lower section is ball-shaped.

7. A container, as set forth in claim 6, wherein said ball-shaped lower section forms three-quarters of a sphere.

8. A container, as set forth in claim 6, wherein the transition point between said ball-shaped lower section and said upper section forms a point of inflection and a tangent to the outer wall surface of said ball-shaped lower section at the point of inflection forms an angle of approximately 45° with the vertical axis of said container.

9. A container, as set forth in claim 1, wherein a platform is positioned at the upper end of said upper section and is arranged to be located above the water level when the container is sunk into position on the ocean floor.

10. A container formed of reinforced concrete can be floated into position at an offshore location and sunk onto the ocean floor, the container can be used for the storage of liquid, such as crude oil, wherein the improvement comprises that the container has an upwardly extending longitudinal axis, a bottom, and a lateral portion extending upwardly from the botton, said container includes a lower hollow container section forming the bottom and a part of the lateral portion of the container and an upper hollow container section having a smaller diameter than said lower section and forming another part of the lateral portion of the container, said lower section including the bottom and lateral portion thereof formed as a body of rotation having a curved generatrix with a variable diameter about the longitudinal axis of the container and a curved bottom, said upper section connected to and extending upwardly from the upper end of said lower section and the diameter of said upper section decreasing in the upward direction from its connection to said lower section, the maximum diameter of said upper section being less than the maximum diameter of said lower section, and said curved bottom of said lower section permitting the support for the container when the longitudinal axis of the container is disposed at an angle to the vertical, a plurality of the containers are arranged in a group and are located with the longitudinal axes thereof disposed in inclined positions from the vertical and with the upper ends of the upper sections thereof disposed in contacting relationship, and a common platform interconnecting the upper ends of the upper sections of said containers.

11. A container, as set forth in claim 10, wherein three containers form the group of containers with said lower sections of said containers each disposed at a different corner of a triangle.

12. A container, as set forth in claim 10, wherein a circular sector-shaped platform element is secured to the upper end of said upper section of each container and said platform elements are interconnected to form said common platform.

* * * * *